US005880433A

United States Patent [19]

Eller et al.

[11] Patent Number: 5,880,433

[45] Date of Patent: Mar. 9, 1999

[54] ROD-TYPE FLAME GLOW PLUG

[75] Inventors: Martin Eller, Ludwigsburg; Ulrich Stephan, Erligheim, both of Germany

[73] Assignee: Beru Ruprecht GmbH & Co. KG, Ludwigsburg, Germany

[21] Appl. No.: 901,430

[22] Filed: Jul. 25, 1997

[30] Foreign Application Priority Data

Jul. 26, 1996 [DE] Germany ..... 196 30 402.4

[51] Int. Cl.[6] ..... F23Q 7/00

[52] U.S. Cl. ..... 219/270; 219/544; 219/546; 123/145 A; 361/264

[58] Field of Search ..... 219/270, 544, 219/546; 123/145 A; 361/264, 265, 266

[56] References Cited

U.S. PATENT DOCUMENTS

| | | | |
|---|---|---|---|
| 2,506,768 | 5/1950 | Bentz et al. . | |
| 3,065,436 | 11/1962 | Kayko et al. . | |
| 5,091,631 | 2/1992 | Dupuis et al. | 219/270 |
| 5,319,180 | 6/1994 | Locher et al. | 219/270 |
| 5,468,933 | 11/1995 | Eller | 219/270 |
| 5,521,356 | 5/1996 | Bauer | 219/270 |
| 5,645,742 | 7/1997 | Schmidt et al. | 219/270 |
| 5,664,547 | 9/1997 | Klak et al. | 123/549 |

FOREIGN PATENT DOCUMENTS

| | | |
|---|---|---|
| 0 648 978 | 4/1995 | European Pat. Off. . |
| 2 433 251 | 3/1980 | France . |
| 1 065 538 | 3/1960 | Germany . |
| 88 09 396.4 | 12/1989 | Germany . |
| 43 01 252 | 7/1994 | Germany . |
| WO 91/18244 | 11/1991 | WIPO . |

*Primary Examiner*—John A. Jeffery
*Assistant Examiner*—Vinod D. Patel
*Attorney, Agent, or Firm*—Sixbey, Friedman, Leedom & Ferguson; David S. Safran

[57] ABSTRACT

A rod-type flame glow plug, with a glow tube (5), an inner pole (7), a coil combination having at least one control and glow coil (4) located in series with an ignition coil (3.2) in the glow tube (5), the ignition coil (3.2) being located at the tip of glow tube (5), making in contact with the glow tube, avoids problems associated with nonuniform centering of the coils in the glow tube by the coil combination being located predominantly within a tubular component (1) made of a heat-resistant material. The inner surface of the tubular component (1) adjoins the coil combination, and the outer surface of the tubular component (1) adjoining the inner surface of glow plug (5).

6 Claims, 2 Drawing Sheets

ROD-TYPE FLAME GLOW PLUG

BACKGROUND OF THE INVENTION

1. Field of the Invention

The invention relates to a rod-type flame glow plug for preheating the intake air of an internal combust ion engine, especially a diesel engine. More specifically, the present invention relates to a rod-type flame glow plug having a glow tube with an inn er p ole, a coil combination of at least one control and glow coil located in series in the glow tube with an ignition coil, the ignition coil being located at the tip of glow tube and making contact with the glow tube.

2. Description of Related Art

Rod-type flame glow plugs of the type to which the invention is directed are known, for example, from German Patent 43 01 252 and corresponding U.S. Pat. No. 5,468,993. The disadvantage of these rod-type flame glow plugs is the difficulty of arranging the coils exactly concentrically in the glow tube so that the distance from the outside edges of the coils to the inside edge of the glow tube is the same; this, in turn, is the prerequisite for heating taking place uniformly so that carbonization does not occur in the vaporizer area due to nonuniform heat formation on the adjacent glow tube wall. In addition, short circuits can occur which are caused by coil areas touching the glow tube. Short circuits can, likewise, be caused by destruction of conventional heating rod seals in the entry area of the inner pole into the glow tube of the plug.

The danger of nonconcentric arrangement of the coil(s) is especially problematic in the area of the glow tube tip at which the end of the glow coil is welded to the glow tube; but can also easily occur when the glow tube into which the coil or coil combination is inserted is filled with insulating material, such as MgO or AlN, for example, because the coils, and especially the 24 volt coils, are easily moved, especially in the control coil area, accordingly the fuel preheating and vaporizer area; however, bending of the coils can also occur during the conventional process of caulking the coil end in the inner pole connection. Here, it should be mentioned that 24 volt coils, as compared to 12 volt coils, have a much thinner cross section; this leads to a very soft spring rate of the 24 volt coils. Thus, 12 V/24 V control coils have diameters of roughly 0.6/0.35 mm and 12 V/24 V heating coils roughly 1.00/0.55 mm.

Finally, lack of roundness occurs with the same aforementioned disadvantages in the production of the coil combinations; this applies especially in the so-called 24 volt coils. The proportion of coils which are bent by careless transport is also not inconsiderable.

SUMMARY OF THE INVENTION

The object of this invention is to provide a rod-type flame glow plug of the indicated type, in which the aforementioned disadvantages are eliminated, and which, moreover, work more quickly and efficiently, so that engine starting time is ultimately reduced.

The object according to the invention is achieved by the coil combination being located essentially in a tubular component of heat-resistant material which has an inner surface adjoins the outer surface of coil combination and which has an outer surface which adjoins an inner surface of glow plug tube.

These and further objects, features and advantages of the present invention will become apparent from the following description when taken in connection with the accompanying drawings which, for purposes of illustration only, show a single embodiment in accordance with the present invention.

DETAILED DESCRIPTION OF THE PREFERRED EMBODIMENT

Figure 1:
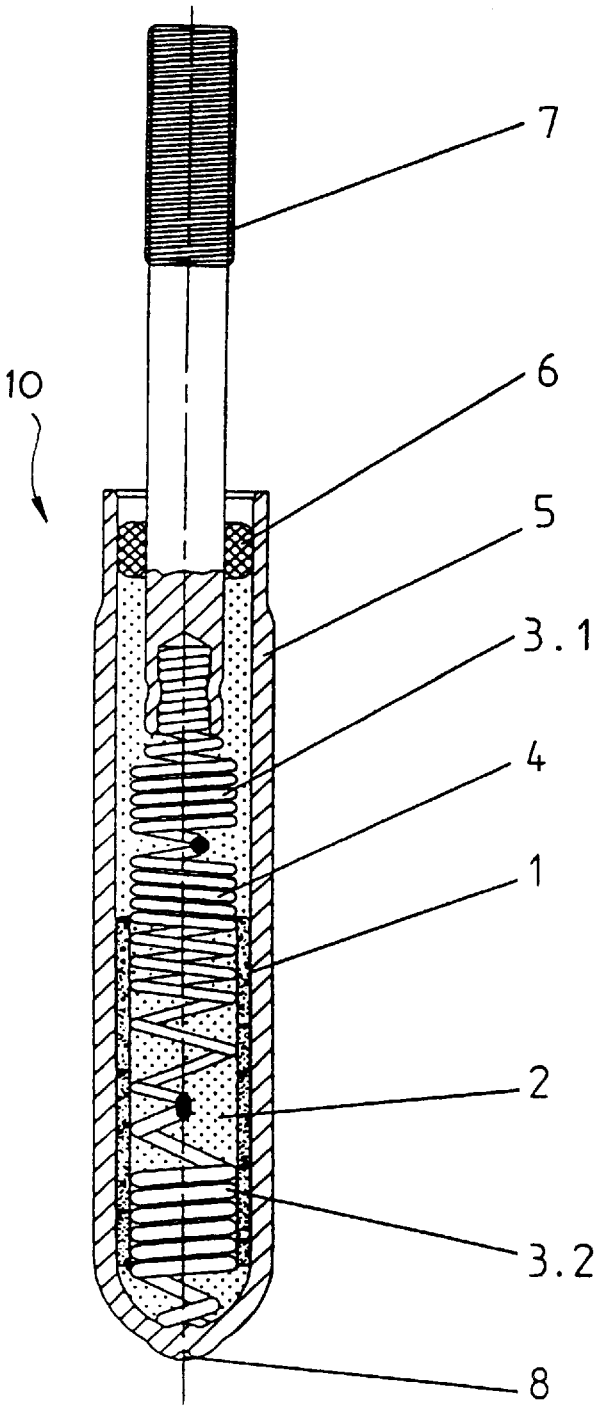
FIG. 1 shows a schematic longitudinal section through a heating rod of one embodiment of the rod-type flame glow plug of the invention.

According to FIG. 1, the heating rod of this embodiment of the rod-type flame glow plug of the present invention has a glow tube 5 in which a preheat coil 3.1, a control coil 4 and an ignition coil 3.2 are located in series one after another. The outwardly directed end of the preheat coil 3.1 is conductively joined to an inner pole 7, for example, by peening.

In the area where the inner pole 7 enters into the glow tube 5, the glow tube is sealed by a silicone gasket. The innermost end of ignition coil 3.2 is welded to the tip of the glow tube in the area of weld point 8. In this embodiment, a predominant part of the coil combination of the three coils is located in a tubular component 1; here, preferably the outer surfaces of the coils (in this case, only ignition coil 3.2 and control coil 4) adjoin the inner surface of the tubular component 1, while the outside diameter of component 1 corresponds to the inside diameter of glow tube 5, so that it seats thereagainst and thus a uniform distance of the outer area of the glow coils to the inside wall of glow tube 5 and uniform heating thereof are guaranteed. Tubular component 1 is formed of a heat-resistant, electrically insulating material, preferably a ceramic material, and especially essentially of MgO, AlN and similar suitable materials. Glow tube 5 is otherwise filled with conventional insulating material 2.

Figure 2:
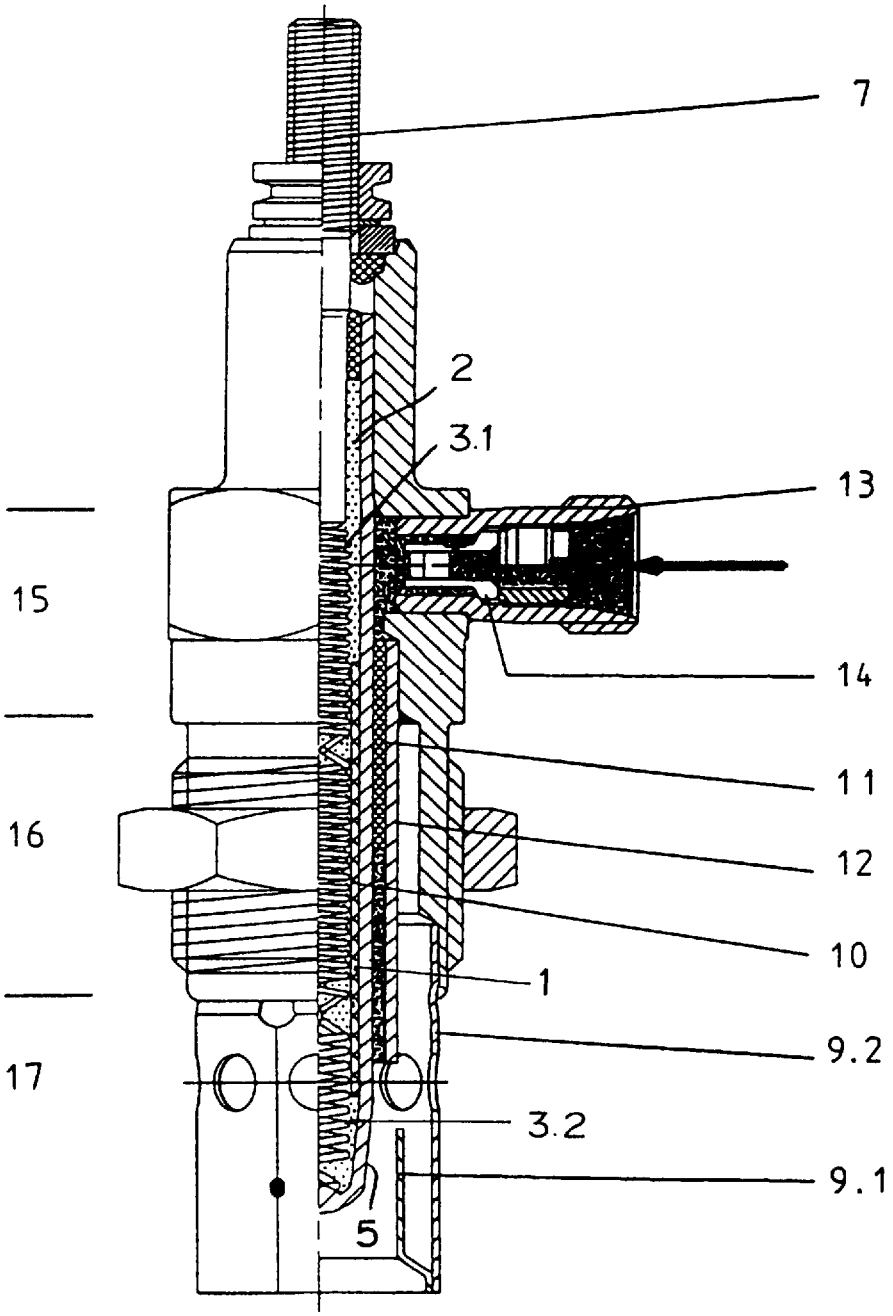
FIG. 2 is a partial longitudinal section through an embodiment of a rod-type flame glow plug with the heating rod according to FIG. 1.

The embodiment of the rod-type flame glow plug which is shown in FIG. 2 has the described heating rod according to FIG. 1; accordingly, the like numbered reference numerals designate the same elements in both figures. Depending on the dimensioning of the coils of the coil combination, a preheat zone 15, vaporizer zone 16 and ignition zone 17 are formed. The fuel (here diesel oil) enters the plug via fuel connection 13, metering taking place via choke diaphragm 14. The intermediate space between a vaporizer tube 12 and the heating rod 10 is filled with a vaporizer wire gauze 11 in which heat transfer takes place to vaporize the fuel. A protective tube 9.2 and a flame damping sleeve 9.1 complete the rod-type flame glow plug.

The rod-type flame glow plug as claimed in the invention can be produced by peening coil combination 3.1/4/3.2 to the inner pole and then welding it to glow tube 5 at 8. To ensure a constant distance between the outer surfaces of the coils and the glow tube 5, ceramic tube 1 is pushed in before the weld between the glow tube 5 and coil combination is produced. Then, insulating material 2 is added, and the entry area of glow tube 5 is sealed relative to the inner pole 7 with a silicone gasket.

An ignition process with the inventive rod-type flame glow plug proceeds such that, after a preliminary glow time and preheat time have expired, in which the tip of heating rod 10 is brought to the ignition temperature and preheat the area 15 is heated, a solenoid valve commences the fuel supply via the fuel connection 13. The fuel then flows through metering insert 14, via the preheat area 15 and vaporizer area 16, in which it is uniformly heated, to the ignition area 17 in which the fuel is then mixed with air entering via protective tube 9.2 and flame damping sleeve 9.1 and ignited.

In addition to the above-mentioned advantages of the invention, the scrap rate (up to 20%) in the production of heating rods can be reduced such that X-ray inspection of the produced heat rods can be abandoned.

While an embodiment in accordance with the present invention has been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. Rod-type flame glow plug having a glow tube with an inner pole, a coil combination of at least one control and glow coil located in series in the glow tube with an ignition coil, the ignition coil being located at the tip of glow tube and making contact with the glow tube; wherein the coil combination is predominantly located in a tubular component of heat-resistant material which has an inner surface which adjoins an outer surface of coil combination and which has an outer surface which adjoins an inner surface of glow tube.

2. Rod-type flame glow plug as claimed in claim 1, wherein the coil combination has a preheat coil connected to the control coil, the preheat coil being joined to the inner pole; and wherein the ignition coil is connected to a tip of the glow tube.

3. Rod-type flame glow plug as claimed in claim 2, wherein the tubular component is formed of a material selected from the group consisting of MgO, AlN and other ceramic materials which are electrically insulating.

4. Rod-type flame glow plug as claimed in claim 1, wherein a silicone seal is provided between the glow tube and the inner pole in an entry area of the glow tube.

5. Rod-type flame glow plug as claimed in claim 1, wherein free space in glow tube is filled with an electrically insulating material.

6. Rod-type flame glow plug as claimed in claim 1, wherein the tubular component is formed of a material selected from the group consisting of MgO, AlN and other ceramic materials which are electrically insulating.

* * * * *